US008408841B2

(12) United States Patent
Brown et al.

(10) Patent No.: US 8,408,841 B2
(45) Date of Patent: Apr. 2, 2013

(54) FLOW RESISTANCE MODIFIER APPARATUSES AND METHODS FOR MOVING FLUIDS

(76) Inventors: Lawrence George Brown, Honolulu, HI (US); Gregory Andrew MacDonald Brown, Incline Village, NV (US)

( * ) Notice: Subject to any disclaimer, the term of this patent is extended or adjusted under 35 U.S.C. 154(b) by 0 days.

(21) Appl. No.: 13/158,380

(22) Filed: Jun. 11, 2011

(65) Prior Publication Data

US 2012/0279578 A1 Nov. 8, 2012

Related U.S. Application Data

(60) Provisional application No. 61/481,741, filed on May 3, 2011, provisional application No. 61/487,601, filed on May 18, 2011.

(51) Int. Cl.
*E02B 7/00* (2006.01)

(52) U.S. Cl. ..... 405/87

(58) Field of Classification Search ..... 405/80, 405/84, 91, 92, 98, 103, 107, 115; 404/6; 441/1, 6, 21, 23–25; 137/625.3, 625.33; 251/212; 256/12.5, 13
See application file for complete search history.

(56) References Cited

U.S. PATENT DOCUMENTS

| | | | |
|---|---|---|---|
| 3,664,366 | A | 5/1972 | Munguet |
| 3,667,234 | A | 6/1972 | Lizasoain |
| 3,992,125 | A | 11/1976 | Schilling |
| 4,052,856 | A | 10/1977 | Trotta |
| 4,130,994 | A | 12/1978 | Van Moss |
| 4,162,864 | A | 7/1979 | Maeda et al. |
| 4,252,461 | A | 2/1981 | Colamussi et al. |
| 4,484,836 | A | 11/1984 | Bailard |
| 5,178,489 | A | 1/1993 | Suhayda |
| 6,167,704 | B1 | 1/2001 | Goldenblum |
| 7,492,054 | B2 | 2/2009 | Catlin |

FOREIGN PATENT DOCUMENTS

| | | |
|---|---|---|
| JP | 11-117269 | 4/1999 |

OTHER PUBLICATIONS

International Search Report and Written Opinion issued in PCT/IB2011/053151, dated Mar. 28, 2012.

*Primary Examiner* — David Bagnell
*Assistant Examiner* — Kyle Armstrong
(74) *Attorney, Agent, or Firm* — Fulbright & Jaworski L.L.P.

(57) ABSTRACT

Provided is a novel flow control system that includes multiple modifier columns for positioning across a waterway. Bottom ends of the columns are attached to a bottom track extension, for example, at the bottom of the waterway. The columns are sufficiently light so that the buoyancy force pushes their top ends towards the surface forming a "curtain-like" structure that provides resistance to the water flow. Spacing between the columns and other characteristics may be used to adjust this resistance. The columns may be repositioned along the track to change the spacing and/or to form an open pass. The columns are sufficiently robust and may swivel with respect to their bottom support such that their upper portions contact passing vessels. The system may be used to control flow through energy extracting devices or be a part of flood control systems.

29 Claims, 5 Drawing Sheets

FLOW RESISTANCE MODIFIER APPARATUSES AND METHODS FOR MOVING FLUIDS

CROSS-REFERENCE TO RELATED APPLICATIONS

This application claims priority of U.S. Provisional Application No. 61/487,601, entitled "FLOW RESISTANCE MODIFIER—FOR MOVING LIQUIDS," filed May 18, 2011, which is incorporated herein by reference in its entirety for all purposes. This application also claims priority of U.S. Provisional Application No. 61/481,741, entitled "ENERGY GENERATOR FROM MOVING FLUIDS," filed May 3, 2011, which is incorporated herein by reference in its entirety for all purposes.

FIELD

This application relates generally to flow resistance modifiers and, more specifically, to flow resistance modifiers used in watershed management and extraction of energy from moving fluids.

BACKGROUND

The approaches described in this section could be pursued, but are not necessarily approaches that have been previously conceived. Therefore, unless otherwise indicated herein, the approaches described in this section are not prior art to the claims in this application and are not admitted to be prior art by inclusion in this section.

Our inability to better influence the flow characteristics of water once it is settled in the topography of any given location has led to tragic results. Our efforts at watershed management and flood control are more limited than they would be, if a good way to influence the rate, and direction, of the flow of meandering waters were available. Additionally, the way could be opened to better harvesting of the clean, renewable energy from flowing waters.

The "tidal and other currents" efforts have overwhelmingly gravitated to underwater turbines (similar to wind towers). However, any device placed in the way of the water's flow creates resistance and the flow tends to go around it. When such devices are grouped in various ways, the flow sees the group as a "porous wall", which collectively still offers higher resistance and tries to move through openings that may be available to one or both sides of the porous wall. What is left to go through the turbines is at so reduced velocity that it produces too little captured energy to matter.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Provided is a novel flow control system that includes multiple modifier columns for positioning across a waterway. Bottom ends of the columns are attached to a bottom track extension, for example, at the bottom of the waterway. The columns are sufficiently light, and the buoyancy force pushes their top ends towards the surface forming a "curtain-like" structure that provides resistance to the water flow. Spacing between the columns and other characteristics may be used to adjust this resistance. The columns may be moved along the track to change spacing and/or to form am open pass. The columns are sufficiently robust and may swivel with respect to their bottom support such that their upper portions may make safe contact with passing vessels. The system may be used to control flow through energy extracting devices and be a part of flood control systems.

In certain embodiments, a flow control system includes a bottom track for positioning at a predetermined depth from a surface of a waterway. The system also includes multiple modifier columns having bottom ends and top ends. The bottom ends are slidably attached to the bottom track and configured to change spacing between the columns. The top ends of the columns are configured to extend towards the surface of the waterway under the buoyancy forces applied to the columns, when submerged in the waterway. The spacing between the multiple modifier columns is configured to control flow in the waterway. In certain embodiments, the top ends are configured to be submerged in the waterway. In other embodiments, the top ends may extend above the surface of the waterway.

In certain embodiments, multiple modifier columns are configured to bend and/or swivel with respect to the bottom track upon applying a force to the upper ends of the columns. The force may be applied by the water flow in the waterway and/or by a vessel passing thru the flow control system and, in certain embodiments, contacting with the modifier columns. In the same or other embodiments, modifier columns include inflatable shells. Such columns may operate at different inflated states. For example, the columns may be additionally inflated to increase their size and their buoyancy characteristics, which in turn results in more flow resistance.

In certain embodiments, a flow control system includes multiple attachment links for attaching the bottom ends of the columns to the bottom track. These links may allow the columns to swivel with respect to the bottom track. In the same or other embodiments, a flow control system includes a positioning bar and multiple positing arms rotatably attached to the bottom ends of the columns as well as to the positioning bar. The positioning bar may extend in parallel to the bottom bar and configured to move in a direction substantially perpendicular to the bottom bar and to the positioning bar such that the multiple positioning arms control the spacing between the columns. The positing arms may be rotatably attached to the positioning bar using multiple positioning bar pins. The flow control system may also include two or more positioning tracks for moving the positing bar with respect to the bottom bar.

In certain embodiments, modifier columns are configured to bend and/or to swivel when forces are applied to upper portions of at least some of the multiple modifier columns by a vessel passing on the surface of the waterway. A flow control system may include a remote control system to remotely control the spacing between the columns. A degree of buoyancy of the columns may be remotely adjustable.

In certain embodiments, a flow control system includes an extension track attached to the bottom track and positioned at an angle to the bottom track. The extension track is configured to receive and return at least some of the multiple modifier columns from and to the bottom track to provide at least a portion of the waterway free from the multiple modifier columns.

In certain embodiments, one or more of the modifier columns have one or more of the following shapes: a balloon-like shape and a cylinder-dike shape. The columns may be made from an elastic material configured to extend and contract at least in between the top ends and bottom ends depending on an air pressure inside the columns. In the same or other embodiments, a distance between the top ends and the bottom ends is adjustable. The top ends may be visible under the surface of the waterway.

In certain embodiments, a flow control method involves positioning a bottom track at a predetermined depth from a surface of a waterway and slidably attaching multiple modifier columns to the bottom track. The modifier columns may be configured to change spacing between the columns. The columns are configured to extend towards the surface of the waterway when submerged. Spacing between the columns is configured to control flow in the waterway. The method may also involve positioning one or more energy extracting devices adjacent to the multiple modifier columns such that the modifier columns and the one or more energy extracting devices extend across the waterway. In certain embodiments, a method involves moving the multiple modifier columns with respect to each other by using a hydraulic mechanism and/or an electrical motor. Changing (increasing or decreasing) spacing between the multiple modifier columns enables changing (reducing or increasing) flow resistance in the waterway.

Provided also is a water shed management method. The method may involve installing a first flow control system in a tributary, installing a second flow control system in a distributary, and installing a third flow control system in a main flow channel. Flow resistance of the first flow control system may be substantially higher than that of the second flow control system. Furthermore, flow resistance of the third flow control system is less than that of the first flow control system and is greater than that of the second flow control system. As such, this arrangement increases flow of water through the distributary and accumulation of water in the tributary as to prevent the main flow channel from overloading. The method may also involve adjusting the flow resistance of the first flow control system, adjusting the flow resistance of the second flow control system, and/or adjusting the flow resistance of the third flow control system. These flow resistances may be adjusted independently.

Provided is an energy harvesting method that involves placing a flow control system adjacent to one or more energy extraction devices. Various examples of flow control systems are described elsewhere. Flow resistance of the flow control system could be set to be the same, or more, than the flow resistance of the one or more of the energy extraction devices.

These and other embodiments are described further below with reference to the figures.

BRIEF DESCRIPTION OF DRAWINGS

Embodiments are illustrated by way of example and not limitation in the figures of the accompanying drawings, in which like references indicate similar elements and in which.

DETAILED DESCRIPTION OF EXAMPLE EMBODIMENTS

Figure 1A:
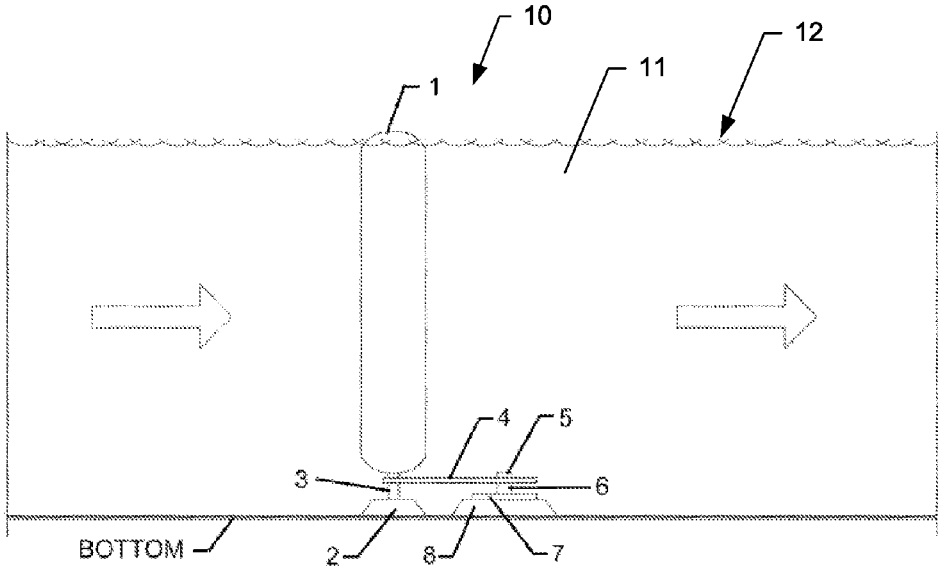
FIG. 1A is a side schematic view of a flow control system installed in a waterway illustrating a modifier column attached to a bottom track, in accordance with certain embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Provided is a novel flow control system that includes multiple modifier columns to provide viable flow resistance to water flow in a waterway. The modifier columns may be positioned in a row across the waterway. Bottom ends of the columns are attached to a bottom track extension at a certain depth from the water surface, for example, as at the bottom of the waterway. The columns are sufficiently light and experience buoyancy forces when partially or fully submerged into the waterway. Since the bottom ends are attached (anchored), the buoyancy forces push the top ends of the columns towards the surface. As such, the columns become "curtain-like" static obstacles in the waterway and provide resistance to the water flow. Spacing between the columns and other characteristics may be used for controlling the flow resistance. For example, the columns may be moved along the bottom track to change spacing between pairs of adjacent columns and/or to form a pass in between two sets of columns (e.g., to allow for a vessel to pass in between these two sets). Another factor that affects the flow resistance is the buoyancy force, which may be controlled by changing size/density of the columns (e.g., by inflating or deflating the columns made from flexible materials). The buoyancy forces affect vertical orientation of the columns (i.e., their vertical angle) that are also subjected to the flow forces, which in turn affects the flow resistance.

The upper portions of the columns may contact a vessel passing thru the flow control system. The vessel may push some of the columns out of the way and create a temporary pass way in between the columns. This may be accomplished without moving the anchored bottom ends of the columns. The temporarily created pass way then closes due to the buoyancy forces. Specifically, the columns may swivel and/or bend with respect to their bottom support to create temporary passes. The system may also create similar passes by moving bottom ends of the columns with respect to the bottom supports/tracks.

In certain embodiments, one or more flow control systems are used for various flood control purposes. Typically, a main flow channel has one or more corresponding tributaries and one or more distributaries. One flow control system may be installed in a tributary, another system in a distributary, and yet another one in a main flow channel. By varying the flow resistance in these three waterways, an effective flood control system may be achieved. When a lower water level is desired in the main flow channel, flow resistance in distributary may be set to a level lower than in the tributary. Such flow control systems and methods may be also used for irrigation control.

In the same or other embodiments, a flow control system is installed together with one or more energy extracting devices, such as turbines or the Newtonian Honeycombs. This approach may allow a more effective use of the energy extracting devices due to more flexible flow resistance control in the vessel navigation channel. Overall, these flow control systems and methods may be used for energy harvesting assistance. For example, systems may be installed in navigational portions of various types of waterways, such as rivers, sea inlets, passages, and serve as material supplements and boosters to energy harvesting devices installed in these waterways.

Because the columns are relatively light and experience constant buoyance force when submerged into a waterway, the columns remain substantially upright or at some small angle when they experience strong water flow or contact with a vessel. The columns may swivel with respect to their attachment points at the bottom track. The buoyancy force may be changed based on an inflation level of the columns. This change in buoyance may be used to control the flow in addition to the change of spacing in between the columns. For example, columns may be inflated to increase their buoyancy and to maintain vertical orientation as to increase flow resistance as compared to, for example, less inflated and angled columns. Furthermore, columns may be formed into a nearly solid vertical wall with minimal spacing between the columns. The degree of buoyancy of each column can be also independently controlled.

FIG. 1A is a side schematic view of a flow control system 10 installed in a waterway 11 illustrating a row of modifier columns 1 attached to a bottom track 2, in accordance with certain embodiments. Waterway 11 contains a flow of water across the row of columns 1, which is shown with two arrows (left to right). The row of columns 1 remains substantially static within the flow due to its attachment to bottom track 2. Bottom track 2 may be attached to the bottom of waterway 11 or, more generally, positioned at a predetermined depth of waterway 11. As such, the row of columns provides resistance to the water flow. The resistance can be controlled as described in more detail below.

Modifier columns 1 may be slidably attached to bottom track 2 via links 3. In other words, bottom track 2 allows modifier columns 1 to move across waterway 11 in order to change spacing between modifier columns 1 or create a passage in waterway 11 that is not obstructed by modifier columns 1. Various types of mechanisms may be employed for moving the columns along bottom track 2. One example, include positioning arms 4 which are attached to links 3 or directly to modifier columns 1. Opposite ends of positioning arms 4 may be pivotally attached using pins 5 to a positioning bar 6. Positioning bar 6 may be slidably mounted on some fixed structures/bottom track 2 using track segments 7, which allow positioning bar 6 to move towards bottom track 2 and away from bottom track 2. This relative motion of positioning bar 6 and bottom track 2 causes positioning arms 4 to push modifier columns 1 away from each other or to bring modifier columns 1 close to each other, respectively.

Modifier columns 1 may be made from a sufficiently strong material capable of withstanding occasional contacts with vessels. The material may be sufficiently flexible not to impair vessels hulls or running gear. FIG. 1A illustrates modifier columns 1 as partially extending above the surface of waterway 11. However, in certain embodiments, modifier columns 1 are fully submerged into the water. Furthermore, flow control system 10 may have modifier columns 1 with variable heights and/or variable lengths of links 3 that allows controlling position of modifier columns 1 with respect to the surface of waterway 11. In certain embodiments, top portions of modifier columns 1 may be kept just below the surface in order to provide some visibility to operators of navigating vessels but otherwise hide flow control system 10 from view (for aesthetic reasons).

Figure 1B:
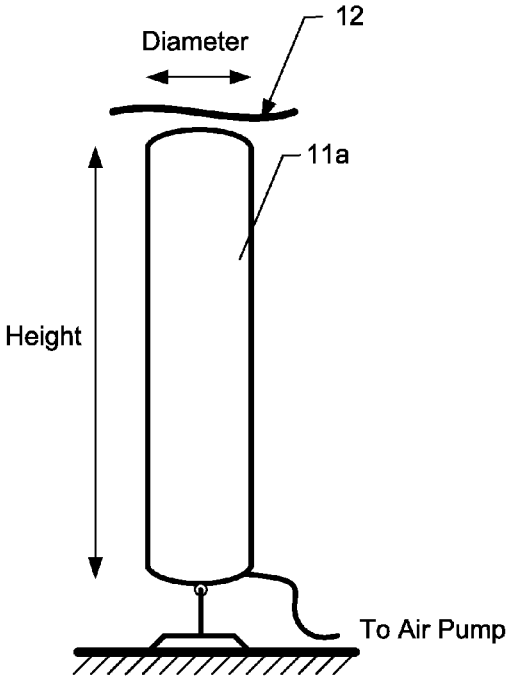
FIG. 1B is a schematic view of an inflated modifier column, in accordance with certain embodiments.
Figure 1C:
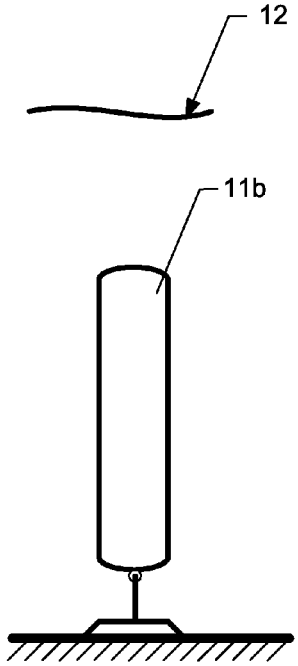
FIG. 1C is a schematic view of a partially deflated modifier column, in accordance with certain embodiments.

When modifier columns 1 are made from certain flexible and/or elastic materials, these columns may also be designed to have a variable volume and, as a result, a variable degree of buoyancy. For example, some or all columns may be attached to an air supply system that allows controlling amount of air in these columns as shown in FIG. 1B. As mentioned above, such columns may have variable heights. Specifically, FIG. 1B provides a schematic view of an inflated modifier column having a size (height and diameter) larger than a partially deflated column shown in FIG. 1C.

A larger a vessel approaching the modifier columns 1 would not have encountered any difficulties in pushing the modifier columns 1 out of the way with its bow. However, it could be more difficult for a smaller vessel to push the columns out of the way especially when going upstream in a strong current. Accordingly, in some embodiments, a sensor mechanism 9*a* can be provided to detect approaching vessels. The sensor mechanism may be made of a light material floating on the surface. Once the vessel is detected, the sensor mechanism may cause (by a direct command or through a signal to a control and command center) an assistant device 9*b* to move (pull or push) the columns out of the way of the vessel. For example, the assistance device may include one or more steel ropes attached to the columns at height below the depth in the channel that the largest vessels could occupy, and an electric winch assembly pulling the steel ropes towards the preferably bottom mounted winch assembly as the winch rotates, thereby moving the columns out of the way of the vessel. In another example, the assistant device may include one or more rigid bars attached to arms pivotally mounted on the bottom, and a hydraulic mechanism coupled to the one or more arms as to move the rigid bar in a circular motion, thereby sweeping the columns out of the way of the vessel.

In certain embodiments, modifier columns 1 are assembled with two or more parts, one or which may be inflatable. Different parts may be screwed vertically or doweled for assembly in such a way that provides some material adjustability for the depth of waterway 11.

Figure 2:
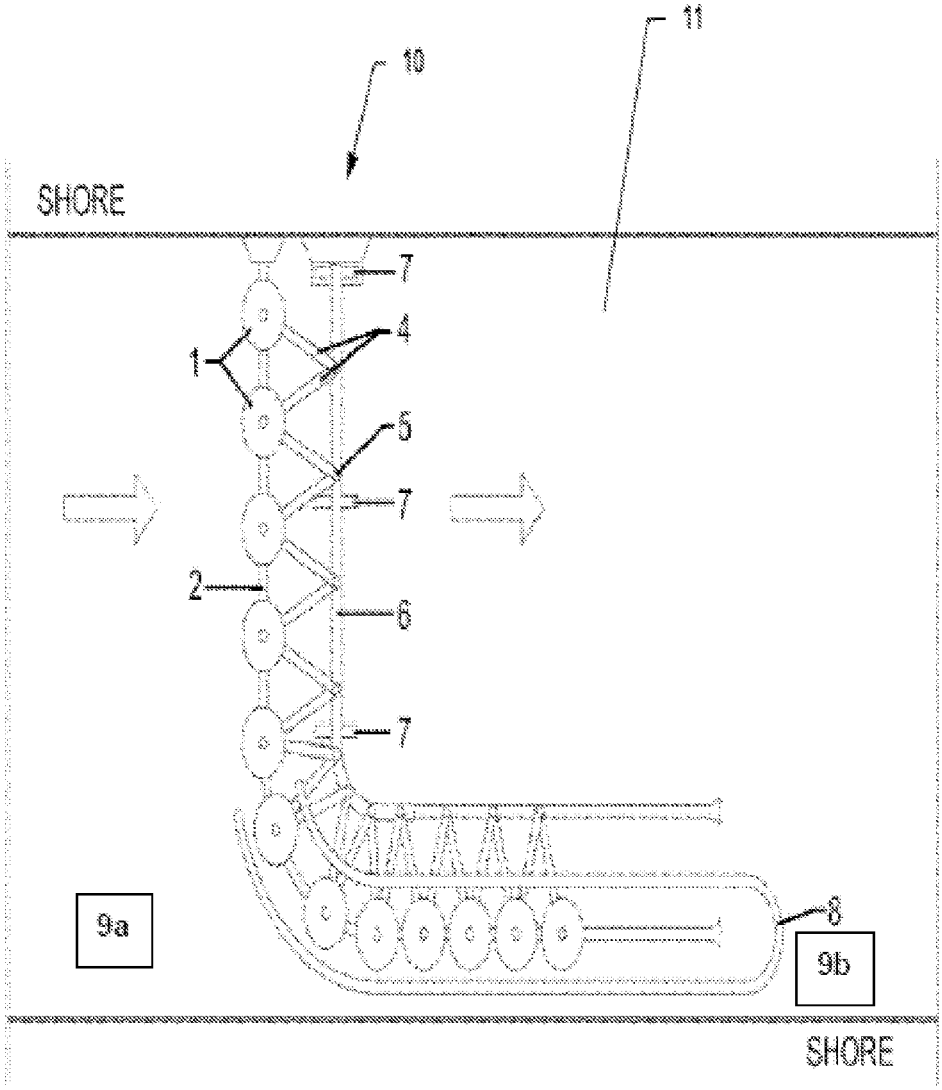
FIG. 2 is a top schematic view of a flow control system illustrating multiple modifier columns, a positioning bar for adjusting spacing between the modifier columns and an extension track for moving selected modifier columns away from the flow, in accordance with certain embodiments.

FIG. 2 is a top schematic view of flow control system 10 illustrating multiple modifier columns 1, positioning bar 6 for adjusting spacing between modifier columns 2 and an extension track 8 for moving selected modifier columns away from the flow, in accordance with certain embodiments. As stated above, modifier columns 1 may be slidably attached to bottom track 2. Positioning bar 6 is moved with respect to bottom track 2, which in turn changes the angle between two adjacent positioning arms 4. This movement either separates two corresponding modifier columns 1 (increases the gap between the two columns and thereby reduces the flow resistance of flow control system 10) or brings the columns closer (thereby increasing the flow resistance of flow control system 10). Movement of positioning bar 6 with respect to bottom track 2 may be accomplished by a hydraulic mechanism (e.g., one or more hydraulic apparatuses disposed along the length of positioning bar 6 and attached to a pump) or an electrical mechanism (e.g., one or more electrical motors disposed along the length of positioning bar 6).

FIG. 2 also illustrates an extension track 8 attached to bottom track 2 and positioned at an angle with respect to bottom track 2. Extension track 8 is configured to receive and return at least some of multiple modifier columns 1 from and to bottom track 2 as to clear at least a portion of waterway 11 free of multiple modifier columns 1. For example, flow control system 10 may include sufficient number of modifier columns 1 to form a row of modifier columns 1 across the entire waterway 11 without any gaps or gaps of a certain minimal predetermined size. When the gap is increased, some columns may need to be moved away so that these columns do not interfere with the flow resistance of flow control system 10. Extension track 8 is used for this purpose and is generally positioned along the flow direction in waterway 11. In certain embodiments, bottom track 2 and extension track 8 are positioned substantially perpendicular with respect to each other.

Figure 3:
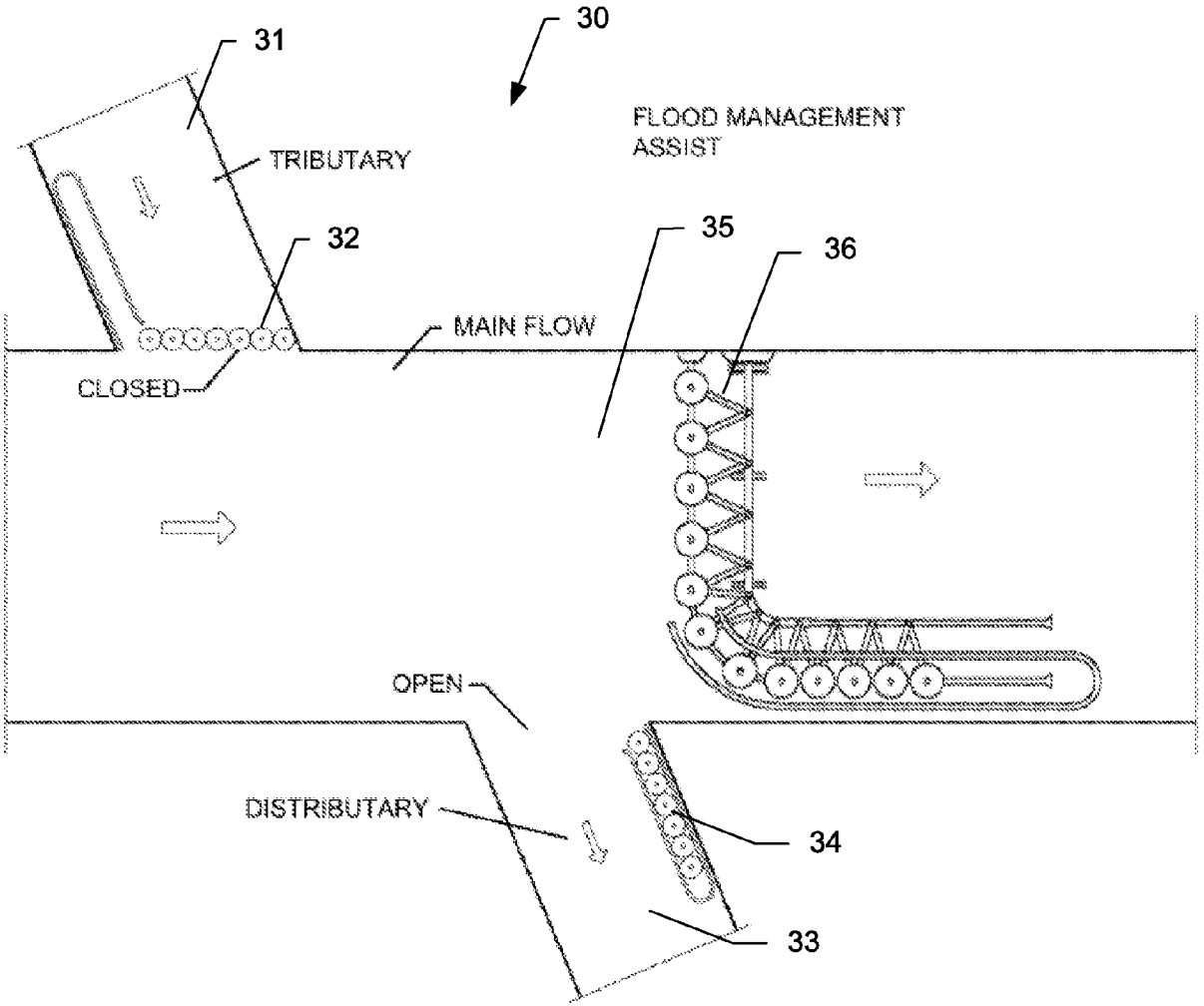
FIG. 3 is a top schematic view of a flood control system including a tributary, a distributor, and a flow control system used for controlling the main flow, in accordance with certain embodiments.

FIG. 3 is a top schematic view of a flood control system 30 including a tributary 31, a distributary 33, and a main flow channel 35 equipped with flow control systems 32, 34, and 36, in accordance with certain embodiments. Tributary 31, also known as "affluent," is an incoming stream (e.g., a river, water channel) that flows into main flow channel 35 (e.g., a river, lake). Distributary 33, also known as "effluent," is an outgoing stream (e.g., a river, water channel) that flows out of main flow channel 35. Tributaries and distributaries may be used to control the water level in the main body of water by controlling how much water goes into the main body and how much water leaves the main body. Flow control systems mentioned above may be used for such purposes and may be installed in tributaries and distributaries as well as in the main flow channel as shown in FIG. 2.

When flood risk is high the level of the main body of water is high), flow resistance in flow control system 32 in tributary 31 may be increased to reduce the water inflow from tributary 31 into main flow channel 35. As shown in FIG. 2, modifier columns of flow control system 32 are arranged in a tight row near the entrance (the "mouth") of distributary 31 into main flow channel 35. Tributary 31 may be connected to other channels into which the water is diverted. At the same time, flow resistance in flow control system 34 in distributary 33 may be decreased to increase the water inflow through distributary 31 into main flow channel 35. FIG. 2 illustrates modifier columns of flow control system 34 moved to the extension track and away from the water flow. Main flow channel 35 is also shown equipped with flow control system 36, which controls the flow between the left side of channel 35, which is in communication with tributary 31 and distributary 33 though their respective flow control system, and right side of channel 35. As such, flow control system 36 may control water levels with channel 35.

Overall, flood control system 30 allows a iced inflow through tributary 31 and the possibility of pushing spillage to less harmful areas around tributary 31. Flood control system 30 also allows an increased outflow through distributary 33 and possibly pushing spillage to less harmful areas around distributary 33. As such, main flow channel 35 may be spared from overloading and flooding and catastrophic floods could be prevented or at least made less frequent.

Figure 4:
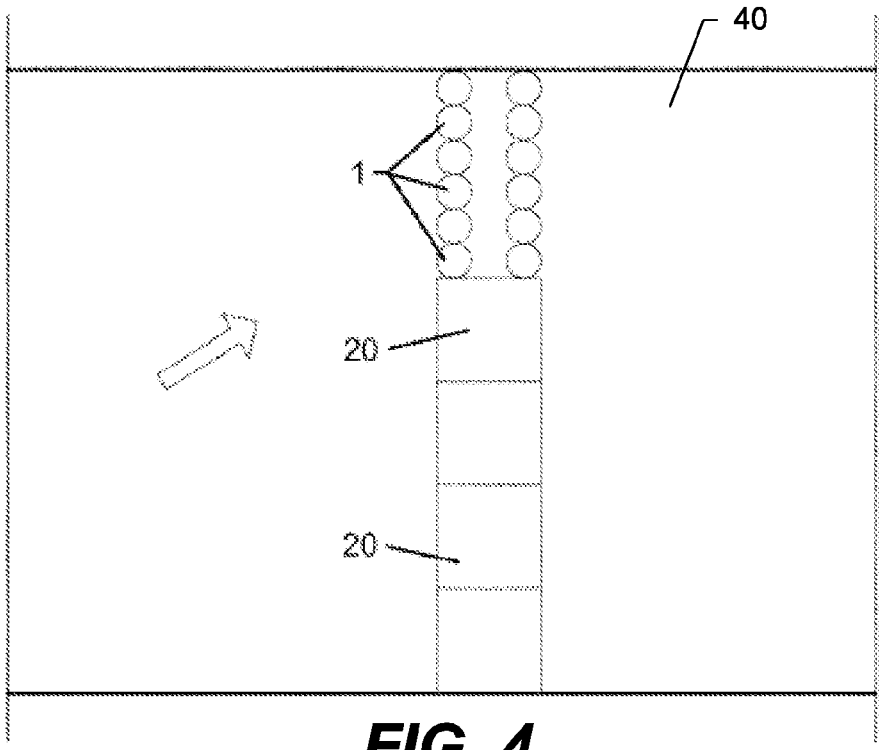
FIGS. 4 and 5 are top schematic views of flow control systems used in waterways for assisting energy harvesting devices, in accordance with certain embodiments.
Figure 5:
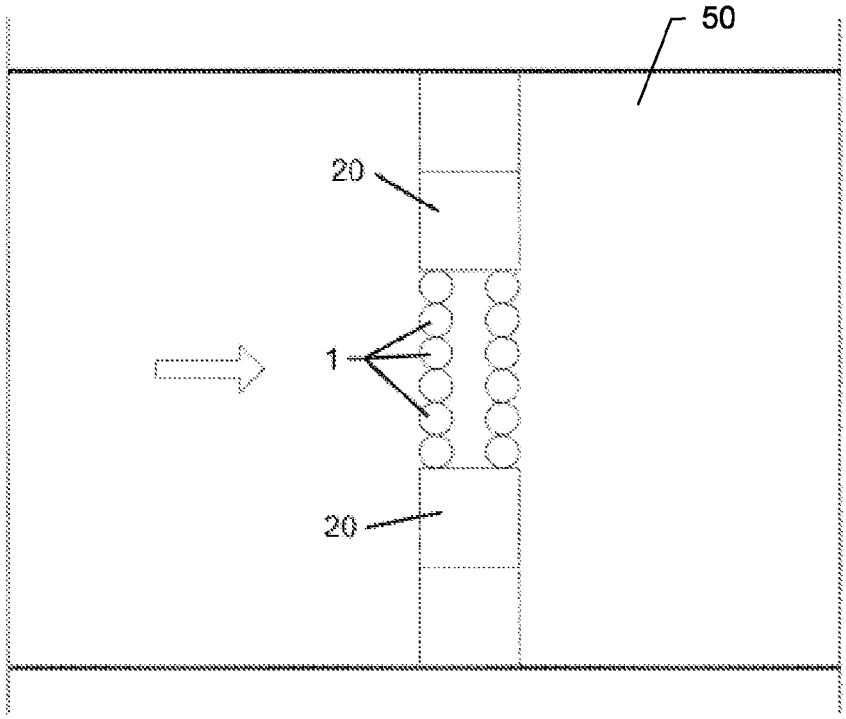

FIGS. 4 and 5 are top schematic views of modifier columns 1 used in waterways 40 and 50 for assisting energy harvesting devices 20, in accordance with certain embodiments. Specifically, modifier columns 1 increase flow resistance through portions of waterways 40 and 50, which are not occupied by energy harvesting devices 20 and thereby increase the flow through energy harvesting devices 20. By increasing the flow velocity though energy harvesting devices 20, which is a key factor in kinetic energy capture, substantially higher energy generation is possible compared to waterways not equipped with modifier columns 1. When energy harvesting devices are positioned within a waterway and a flow around these devices is not restricted, the water tends to flow around the devices and not through them, thereby substantially reducing their energy generation characteristics. FIG. 4 illustrates a typical flow behavior in absence of modifiers (even though modifier columns are shown in waterway 40) or around the "waiting" energy extractors.

Flow control systems described herein may be set to have a specific area porosity, which is defined as a ratio of open area between modifier columns to the total cross-sectional area allocated to the flow control system. For example, porosity of an open unobstructed channel may be set to 1% or 100%. Energy extraction devices may also have corresponding porosity values. In certain embodiments, porosity of a flow control system positioned in parallel to an energy extraction device may be set substantially to the same or less than that of the energy extraction device. For example, a particular energy extraction device may have a porosity of about 50% and the corresponding flow control system set to about 20% porosity. As such, a much larger portion of the total flow (and corresponding kinetic energy) will be directed though the energy extraction device.

Figure 6:
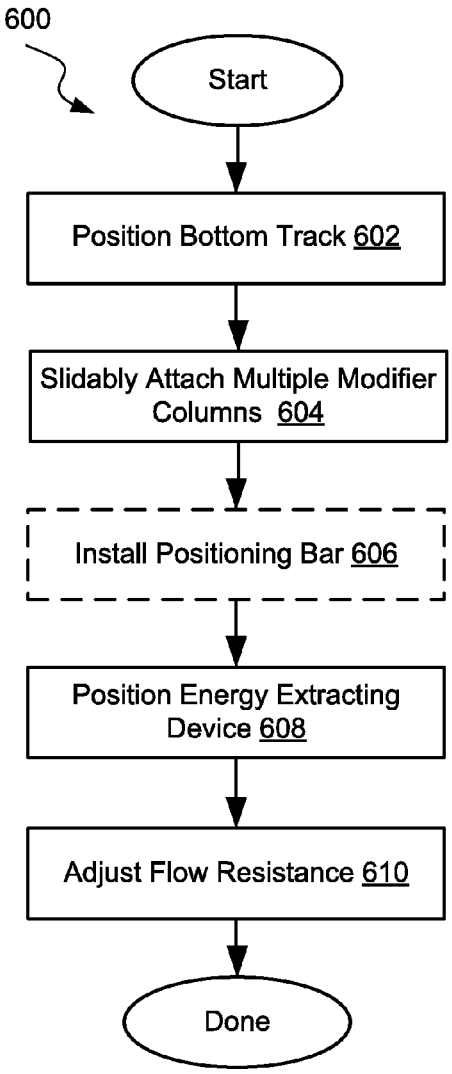
FIG. 6 is a process flow chart illustrating a flow control method that may be used for energy harvesting, in accordance with certain embodiments.

FIG. 6 is a process flow chart illustrating a flow control method 600 that may be used for energy harvesting, in accordance with certain embodiments. Method 600 may commence in operation 602 with positioning a bottom track at a predetermined depth from a surface of a waterway and may continue with slidably attaching multiple modifier columns to the bottom track in operation 604. As described above, these modifier columns create a "curtain-like" obstacle across the waterway. The modifier columns are configured to change spacing between them to change flow resistance. For example, a positioning bar may be installed in optional operation 606.

The multiple modifier columns are configured to extend towards the surface of the waterway after being submerged into the waterway. For example, method 600 may involve attaching the columns to the bottom track when the columns do not experience substantial buoyancy forces. Then columns are inflated and the buoyancy forces are increased forcing the columns towards the surface of the waterway. Because one end of the columns is attached, the buoyance forces keep the column in substantially vertical direction (in the absence of flow). The flow or other forces (e.g., from a vessel passing thru the flow control system) may cause the columns to swivel and/or bend.

Method 600 also involves positioning one or more energy extracting devices adjacent to the modifier columns in operation 608 such that the columns and the one or more energy extracting devices extend across the waterway. Some examples of energy extracting devices are described above. The columns help to restrict the flow in certain areas of the waterway and direct that flow through the energy extracting devices thus increasing their power output.

Method 600 may also involve adjusting flow resistance in operation 610 by changing various characteristics of the columns, such as changing spacing between the columns or buoyancy of the columns. For example, a hydraulic mechanism and/or an electrical motor may be used to move the multiple modifier columns with respect to each other.

Figure 7:
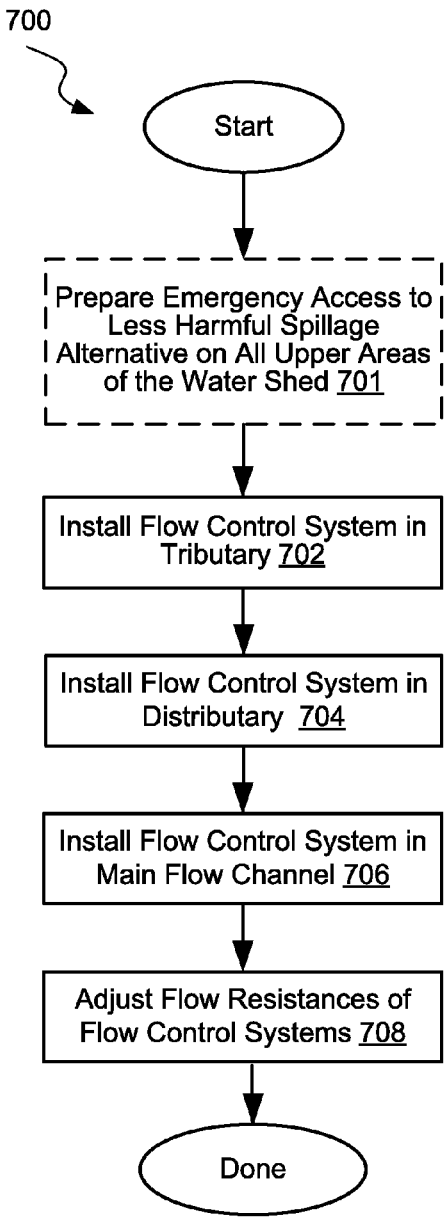
FIG. 7 is a process flow chart illustrating a water shed management method, in accordance with certain embodiments.

FIG. 7 is a process flow chart illustrating water shed management method 700, in accordance with certain embodiments. Method 700 may involve installing a first flow control system in a tributary in operation 702, installing a second flow control system in a distributary in operation 704, and installing a third flow control system in a main flow channel in operation 706. Flow resistance of the first flow control system may be substantially higher than flow resistance of the second flow control system. Furthermore, flow resistance of the third flow control system may be less than the flow resistance of the first flow control system. At the same time, the flow resistance of the third flow control system may be greater than the flow resistance of the second flow control system. This resistance control increases flow of water through the distributary and accumulation of water in the tributary as to prevent the main flow channel from overloading.

Flow resistances of one or more flow control systems may be adjusted in an optional operation 708. For example, method 700 may involve adjusting the flow resistance of the first flow control system, adjusting the flow resistance of the second flow control system, and adjusting the flow resistance of the third flow control system. Flow resistances of each of these systems may be adjusted independently.

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A flow control system comprising:

a bottom track configured to be positioned at a predetermined depth from a surface of a waterway; and multiple modifier columns having bottom ends and top ends, the bottom ends slidably attached to the bottom track and configured to change spacing between the multiple modifier columns, the top ends of the multiple modifier columns configured to extend towards the surface of the waterway under buoyancy forces applied to the multiple modifier columns when submerged into the waterway, wherein the spacing between the multiple modifier columns is configured to be varied to control flow in the waterway between the multiple modifier columns.

2. The flow control system of claim 1, wherein the top ends are configured to be submerged into the waterway.

3. The flow control system of claim 1, wherein the multiple modifier columns are configured to deflect upon applying a force to the upper portions of the multiple modifier columns.

4. The flow control system of claim 1, wherein the multiple modifier columns comprise inflatable shells.

5. The flow control system of claim 4, wherein the multiple modifier columns are configured to operate at different inflated states.

6. The flow control system of claim 1, further comprising multiple attachment links for attaching the bottom ends of the multiple modifier columns to the bottom track.

7. The flow control system of claim 6, wherein the multiple attachment links allow the multiple modifier columns to swivel with respect to the bottom track.

8. The flow control system of claim 1, further comprising a positioning bar and multiple positioning arms rotatably attached to the bottom ends of the multiple modifier columns and rotatably attached to the positioning bar, the positioning bar extending substantially parallel to the bottom track and configured to move in a direction substantially perpendicular to the bottom track and to the multiple modifier columns such that the multiple positioning arms control the spacing between the multiple modifier columns.

9. The flow control system of claim 8, wherein the multiple positioning arms are rotatably attached to the positioning bar using multiple positioning bar pins.

10. The flow control system of claim 8, further comprising two or more positioning tracks for moving the positioning bar with respect to the bottom track.

11. The flow control system of claim 1, wherein the multiple modifier columns are configured to bend and/or to swivel when forces are applied to upper portions of at least some of the multiple modifier columns by a vessel passing on the surface of the waterway.

12. The flow control system of claim 1, further comprising a remote control system for remotely controlling the spacing between the multiple modifier columns.

13. The flow control system of claim 1, wherein a degree of buoyancy of the multiple modifier columns is adjustable.

14. The flow control system of claim 1, further comprising an extension track attached to the bottom track and positioned at an angle to the bottom track, the extension track being configured to receive and return at least some of the multiple modifier columns from and to the bottom track to clear at least a portion of the waterway free of the multiple modifier columns.

15. The flow control system of claim 1, wherein one or more of the multiple modifier columns have one or more shapes selected from the group consisting of: a balloon-like shape and a cylinder-like shape.

16. The flow control system of claim 1, wherein the multiple modifier columns comprise an elastic material configured to extend and contract at least in between the tops ends and the bottom ends depending on an air pressure inside the multiple modifier columns.

17. The flow control system of claim 1, wherein a distance between the top ends and the bottom ends is adjustable.

18. The flow control system of claim 1, wherein the top ends are visible under the surface of the waterway.

19. The flow control system of claim 1, further comprising:

a sensor mechanism to detect an approaching vessel; and an associate mechanism to move the multiple modifier columns out of the way of the approaching vessel in response to the detection of the approaching vessel by the sensor mechanism.

20. A flow control method comprising:

positioning a bottom track at a predetermined depth from a surface of a waterway; and slidably attaching multiple modifier columns to the bottom track, wherein the multiple modifier columns are configured to extend towards the surface of the waterway when submerged into the waterway, wherein the spacing between the multiple modifier columns is configured to be varied to control flow in the waterway between the multiple modifier columns.

21. The flow control method of claim 20, further comprising positioning one or more energy extracting devices adjacent to the multiple modifier columns, wherein the multiple modifier columns and the one or more energy extracting devices extending across the waterway, and wherein flow resistance of the flow control system is about the same or more than the flow resistance of the one or more of the energy extraction devices.

22. The flow control method of claim 20, further comprising moving the multiple modifier columns with respect to each other using a hydraulic mechanism.

23. The flow control method of claim 20, further comprising moving the multiple modifier columns with respect to each other using an electrical motor.

24. The flow control method of claim 20, further comprising increasing spacing between the multiple modifier columns to reduce flow resistance in the waterway.

25. The flow control method of claim 20, further comprising decrease spacing between the multiple modifier columns to increase flow resistance in the waterway.

26. The flow control method of claim 20, where the bottom track and the multiple modifier columns comprise a first flow control system, and the waterway is a tributary, and where the method further comprises:

installing a second flow control system in a distributary of the tributary, wherein flow resistance of the first flow control system is substantially higher than flow resistance of the second flow control system.

27. The flow control method of claim 26, further comprising:

adjusting the flow resistance of the first flow control system;

adjusting the flow resistance of the second flow control system; and adjusting the flow resistance of the third flow control system.

28. The flow control method of claim 27, wherein the flow resistances of the first flow control system, the second flow control system, and of the third flow control system are adjusted independently from each other.

29. The flow control method of claim 20, wherein the multiple modifier columns are configured to deflect upon applying a force to the upper portions of the multiple modifier columns.

* * * * *